United States Patent [19]

Sistare

[11] 4,271,342

[45] Jun. 2, 1981

[54] LOCK-ON TRIGGER SWITCH WITH INTEGRAL RETURN SPRING

[75] Inventor: James R. Sistare, Pickens, S.C.

[73] Assignee: The Singer Company, Stamford, Conn.

[21] Appl. No.: 150,256

[22] Filed: May 15, 1980

[51] Int. Cl.[3] ..... H01H 3/02; H01H 9/06

[52] U.S. Cl. ..... 200/157; 200/321; 200/327; 200/328

[58] Field of Search ..... 200/157, 321, 327, 328, 200/329, 330, 334, 340

[56] References Cited

U.S. PATENT DOCUMENTS

| | | | |
|---|---|---|---|
| Re. 30,270 | 5/1980 | Piber | 200/328 |
| 3,309,484 | 3/1967 | Frenzel | 200/327 |
| 4,023,001 | 5/1977 | Lafferty, Sr. | 200/321 |
| 4,044,215 | 8/1977 | Leibinger et al. | 200/321 |
| 4,054,766 | 10/1977 | Kamer | 200/157 |

FOREIGN PATENT DOCUMENTS

| | | | |
|---|---|---|---|
| 2335972 | 1/1975 | Fed. Rep. of Germany | 200/328 |

*Primary Examiner*—Willis Little

*Attorney, Agent, or Firm*—James M. Trygg; Robert E. Smith; Edward L. Bell

[57] ABSTRACT

A manually actuatable power control device for controlling a power switch in a portable appliance. The power control device is of one-piece construction and has an integrally formed spring member for biasing the control means to a preferred position. The control means is constrained to partake of linear motion for effecting control of the power switch.

4 Claims, 3 Drawing Figures

LOCK-ON TRIGGER SWITCH WITH INTEGRAL RETURN SPRING

DESCRIPTION

1. Background of the Invention

This invention relates to portable appliances such as a portable motor driven tool and in particular to an operator actuatable device for controlling the appliance power switch.

Some form of a finger actuated trigger mechanism is usually employed for this purpose. Such trigger mechanism may include an actuating portion which projects through the wall of the appliance housing and is positioned for convenient operator access, an engagement portion which operationally engages the power switch, and a return spring for returning the actuating portion to its original position after release by the operator. The actuating portion of the trigger mechanism is usually constrained to move in an arcuate path, one end of the actuating portion being pivotally attached to the appliance housing or frame. This type of construction utilizing arcuate movement sometimes embodies an integrally formed return spring. See for example, U.S. Pat. Nos. 4,054,766, Oct. 18, 1977, Kramer; 3,867,591, Feb. 18, 1975, Nordeen; 3,847,233, Nov. 12. 1974, Grover et al; and 3,646,298, Feb. 29, 1972, Weber et al. Another type of construction utilizing a linear movement for the actuating portion embodies a separate return spring element.

2. Summary of the Invention

It is an object of this invention to produce a novel control device for controlling a power switch of a portable appliance having a unique linear actuating motion.

It is another object of this invention to produce a control device for controlling a power switch that is of inexpensive one piece construction and may be easily manufactured and assembled in the appliance.

It is another object of this invention to produce a control device for controlling a power switch having a return spring member integral thereto.

Other objects and advantages of this invention will become apparent through reference to the accompanying drawings and descriptive matter which illustrate a preferred embodiment of this invention.

According to the present invention there is provided manually actuatable power control means for controlling a power switch in a portable appliance. There is a manually actuated slide member of integral one piece construction having an outwardly extending resilient spring portion. A guide means constrains the manually actuated motion of the slide member to linear motion. A holding means engages the spring portion so that a biasing force is effected in opposition to the manually actuated motion.

BRIEF DESCRIPTION OF THE DRAWINGS

In order that the invention be more fully understood, it will now be described by way of example with reference to the accompanying drawings in which.

DESCRIPTION OF THE PREFERRED EMBODIMENT

Figure 1:
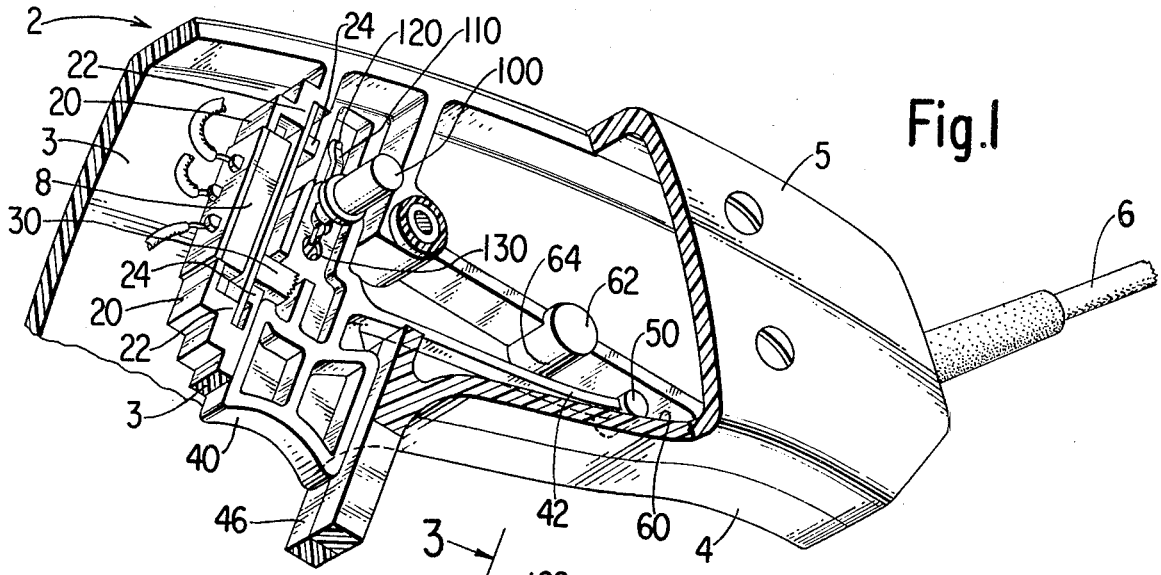
FIG. 1 is a cutaway perspective view of the handle portion of a portable appliance showing a preferred embodiment of this invention.
Figure 2:
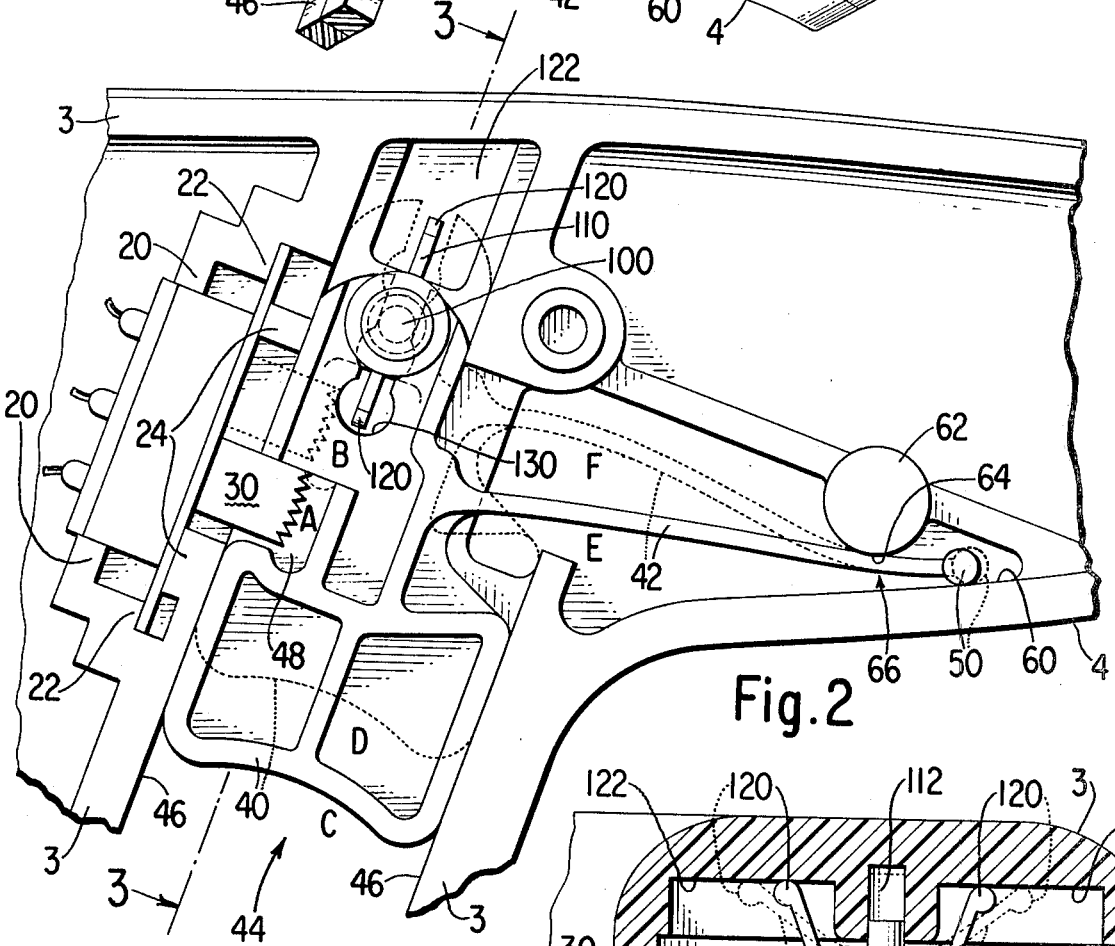
FIG. 2 is an enlarged elevational view of a portion of the preferred embodiment shown in FIG. 1 with the cover removed.
Figure 3:
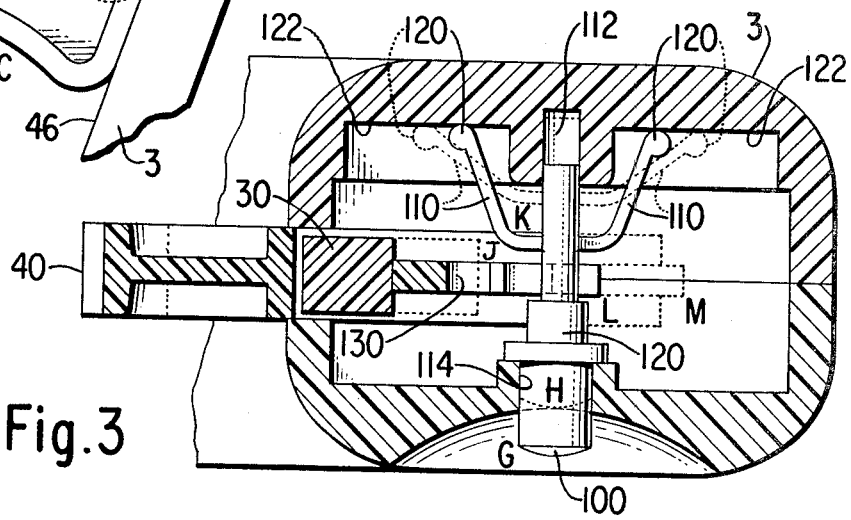
FIG. 3 is a cross-sectional view of the preferred embodiment of this invention taken along the line 3—3 of FIG. 2.

Referring to FIGS. 1 through 3, there is shown a portable appliance 2 having a housing 3, a hand grip portion 4, a cover 5 removably fastened to the grip portion 4, an electric supply circuit 6, and an electric switch 8 arranged to control the power from the supply circuit 6. The electric switch 8 is of the slide type and is rigidly held within the appliance 2 by bosses 20, 22, and 24 which are integrally molded into the housing 3. The actuator 30 of the slide switch 8 may assume either of two positions A or B as shown in FIG. 2.

A finger actuatable slide member 40 having an integrally formed spring member 42 is adapted for sliding engagement with an opening 44 formed in the housing 3. The opening 44 has two parallel formed surfaces 46 comprising a guide means for constraining the motion of the slide member 40 to linear motion. A cavity 48 formed in the slide member 40 is arranged to receive therein the actuator 30 of the slide switch 8 so that when the slide member 40 is in position C, as shown in FIG. 2, the actuator will be in position A and when the slide member is moved to position D the actuator will be moved to a corresponding position B.

The spring member 42 has formed on its extremity a cylindrical shaped end portion 50 for abutting a surface 60 formed in the housing 3. The surface 60 is relatively smooth and of an angle relative to the linear motion of the slide member 40, which permits a slight to and fro motion of the end portion 50 as the slide member is moved between the two positions C and D, as shown in FIG. 2. A boss 62 formed in the housing 3 has a curved surface 64 which abuts the spring member 42 at 66 and causes a moment to be applied to the slide member 40 thereby urging the slide member to assume position C.

In operation, when the slide member 40 is in its unactuated position C the actuator 30 is positioned so that the electric switch 8 does not conduct power from the supply circuit 6. As the slide member 40 is moved by finger pressure to position D the actuator 30 of the slide switch 8 is moved to the corresponding position B thereby causing the slide switch 8 to conduct power. As the slide member 40 moves from position C to position D the spring member 42 moves from position E to position F deflecting about the curved surface 64 causing the end portion 50 to slide to and fro slightly on the surface 60. A moment is thereby maintained urging the slide member 40 outward to position C.

Another arrangement of the invention is shown in FIG. 3. Here a finger actuated slide member 100 having integrally formed spring members 110 is adapted for sliding engagement with concentric holes 112 and 114 formed in the housing 3. The extremities 120 of the spring members 110 abut the surface 122 so that a moment is applied to the slide member 100 urging it outward to position G. The surface 122 is relatively smooth and formed normal to the common axis of the concentric holes 112 and 114. The slide member 100 has formed coaxially therewith a diameter 120 which is adapted to lockingly engage a hole 130 formed in the slide member 40 when the slide member is moved to position D.

In operation, when the slide member 40 is depressed to position D in opposition to the moment applied thereto by the spring member 42, the axis of the hole 130 will coincide with the axis of the concentric holes 112 and 114. The slide member 100 may then be depressed to position H in opposition to the moment applied thereto by the spring members 110 whereby the diameter 120 engages the hole 130. The slide member 40 is then released causing the spring member 42 to force the wall of the hole 130 against the diameter 120 and thereby locking, by friction, the two slide members 40 and 100 in their respective positions D and H. To disengage the two slide members, finger pressure is applied to the slide member 40 sufficient to relieve the friction between the hole 130 and the diameter 120 so that the spring members 110 can urge the slide member 100 to return to position G. This method of utilizing the hole 130 and the diameter 120 for locking the two slide members 40 and 100 in their respective positions D and H is well known in the art as are a variety of similar arrangements.

The construction described above results in several advantages. The one piece construction of the slide member and integral spring member lends itself to efficient molding techniques thereby making it simpler and less costly to manufacture. Additionally, the one piece construction simplifies the assembly procedure thereby reducing defective end products due to faulty assembly.

Upon reviewing the present disclosure, a number of alternative constructions will occur to one skilled in the art. Such constructions may have various configurations of slide members and associated integral spring members which partake of a linear motion for controlling the power switch of a portable appliance. Such alternative constructions are considered to be within the spirit and scope of this disclosure.

I claim:

1. In a portable appliance having an outer housing such as a portable motor driven tool, or the like, an operator actuatable control means for controlling an electric switch comprising:

a. a finger actuatable slide member of integral one piece construction having an outwardly extending resilient spring portion, said slide member adapted for manually actuated motion with respect to said appliance;

b. a guide means attached to said appliance for constraining said motion of said slide member to a linear motion in a predetermined direction;

c. wherein said spring portion is cantilevered from said slide member and formed approximately perpendicular to said direction of said linear motion, said spring portion being of rectangular cross section and having an extremity terminating in a generally cylindrical shaped portion; and d. an abutting means for engaging said spring portion so that a biasing force is effected in opposition to said manually actuated motion comprising a flat surface formed in said outer housing approximately perpendicular to said direction of said linear motion and a boss in said housing having a curved surface and arranged in pressing contact with said spring portion at a point a finite distance away from said extremity so that said cylindrical shaped portion is in pressing contact with said flat surface whereby when said slide member is actuated by the operator's finger said cylindrical shaped portion will slide to-and-fro on said flat surface and said spring portion will assume the general shape of the letter S.

2. A portable appliance such as a portable motor driven tool, or the like, having an outer housing, a handle portion for grasping by the operator's hand, and an operator actuatable control means for controlling an electric switch comprising:

a. a finger actuatable slide member of integral one piece construction having an outwardly extending resilient spring portion, said slide member adapted for manually actuated motion with respect to said appliance;

b. a guide means attached to said appliance for constraining said motion of said slide member to a linear motion in a predetermined direction;

c. wherein said guide means comprises a slot formed in said housing having two spaced apart parallel sides;

d. wherein said slide member has two substantially flat and parallel sides adapted for sliding engagement with said slot sides and an arcuate surface formed therein substantially perpendicular to said sides for engagement with the operator's finger;

e. wherein said spring portion is cantilevered from said slide member and formed approximately perpendicular to said two parallel sides, said spring portion being of rectangular cross section and having an extremity terminating in a generally cylindrical shaped portion; and f. an abutting means for engaging said spring portion so that a biasing force is effected in opposition to said manually actuated motion comprising a flat surface formed in said outer housing approximately perpendicular to said slot and a boss in said housing having a curved surface and arranged in pressing contact with said spring portion at a point a finite distance away from said extremity so that said cylindrical shaped portion is in pressing contact with said flat surface whereby when said slide member is actuated by the operator's finger said cylindrical shaped portion will slide to-and-fro on said flat surface and said spring portion will assume the general shape of the letter S.

3. A portable appliance as set forth in claim 2 farther comprising:

a hole having two concentric diameters formed in said housing;

a sliding lock of integral one-piece construction having two concentric diameters formed thereon and adapted for sliding engagement with said hole, an actuating end projecting outwardly of said housing for engagement with the operator's finger, and two outwardly extending resilient spring portion halves each of which is cantilevered from opposite sides of one of said two concentric diameters, said two halves each being L-shaped and having a rounded extremity that extends beyond said one of said two concentric diameters; and a flat surface formed in said housing substantially perpendicular to said hole and in pressing contact with said rounded extremities so that said actuating end is urged to a position projecting outwardly of said housing; and wherein said slide member further comprises an extended portion having a circular perforation formed therein adapted to be concentric to said two concentric diameters of said sliding lock when said slide member is acutated by the operator's finger, whereby when said actuating end is depressed and said slide member released said perforation will lockingly engage said sliding lock.

4. A portable appliance such as a portable motor driven tool, or the like, having an outer housing, a handle portion for grasping by the operator's hand, and an operator actuatable control means for controlling an electric switch comprising:

a. a finger actuatable slide member of integral one piece construction having an outwardly extending resilient spring portion, an actuating end projecting outward of said housing for engagement with the operator's finger, and two concentric diameters formed thereon, said slide member adapted for manually acutuated motion with respect to said appliance;

b. a guide means comprising a hole having two concentric diameters formed in said housing of said appliance adapted for sliding engagement with said two concentric diameters for constraining said motion of said slide member to a linear motion;

c. wherein said spring portion comprises two halves each of which is cantilevered from opposite sides of one of said two concentric diameters, said two halves each being L-shaped and having a rounded extremity that extends beyond said one of said two concentric diameters; and d. an abutting means for engaging said spring portion so that a biasing force is effected in opposition to said manually actuated motion comprising a flat surface formed in said outer housing substantially perpendicular to said hole and in pressing contact with said rounded extremities so that said actuating end is urged to a position projecting outward of said housing whereby when said slide member is actuated by the operator's finger said rounded extremities of said spring portion halves will slide on said flat surface, each rounded extremity sliding radially away from said one of said two concentric diameters.

* * * * *